US006159036A

United States Patent [19]

Daoud

[11] Patent Number: 6,159,036

[45] Date of Patent: Dec. 12, 2000

[54] LOCKING LATCH MECHANISM FOR AN INSULATION DISPLACEMENT CONNECTOR

[75] Inventor: Bassel Hage Daoud, Parsippany, N.J.

[73] Assignee: Lucent Technologies Inc., Murray Hill, N.J.

[21] Appl. No.: 09/264,791

[22] Filed: Mar. 9, 1999

[51] Int. Cl.[7] ..... H01R 11/20

[52] U.S. Cl. ..... 439/409; 292/102; 292/203; 292/114

[58] Field of Search ..... 439/409, 410, 439/417; 292/95, 102, 107, 108, 110, 101, 229, 203, 209, 210, DIG. 4, DIG. 11, DIG. 37, 128, 114, 241, 129

[56] References Cited

U.S. PATENT DOCUMENTS

| | | | |
|---|---|---|---|
| 767,567 | 8/1904 | Keil | 292/108 |
| 804,994 | 11/1905 | Andrews | 292/210 |
| 1,589,912 | 6/1926 | Weiss | 292/114 |
| 2,670,981 | 1/1954 | Wenham | 292/DIG. 37 |
| 3,611,264 | 10/1971 | Ellis, Jr. | 339/99 R |
| 3,709,538 | 1/1973 | Seitz et al. | 292/128 |
| 3,909,050 | 9/1975 | Vicendese et al. | 292/128 |
| 4,093,176 | 6/1978 | Contastin | 249/167 |
| 4,632,595 | 12/1986 | Schaeff | 403/330 |
| 4,662,699 | 5/1987 | Vachhani et al. | 339/97 |
| 4,913,659 | 4/1990 | Doyle | 439/395 |
| 4,930,818 | 6/1990 | Gerhardsson | 292/29 |
| 4,952,160 | 8/1990 | Olsen | 439/142 |
| 5,675,890 | 10/1997 | Yamamoto et al. | 29/861 |
| 5,855,491 | 1/1999 | Hintner et al. | 439/409 |
| 5,989,054 | 11/1999 | Fasce | 439/409 |
| 5,989,055 | 11/1999 | Cowan et al. | 439/409 |
| 5,993,264 | 11/1999 | Daoud | 439/676 |

*Primary Examiner*—B. Dayoan
*Assistant Examiner*—Clifford B Vaterlaus
*Attorney, Agent, or Firm*—Stroock & Stroock & Lavan LLP

[57] ABSTRACT

A locking latch mechanism for an insulation displacement connector comprises a cap section including a biasing member, a base section and a latch member. The cap section is movable between an open position and a closed position. The base section is hingedly connected to the cap section and includes a latch retaining portion. The latch member is movable between an engaged position and a disengaged position such that the latch member maintains the cap section in the closed position when the latch member is in the engaged position. The latch member includes a latch engaging portion which is lockingly matingly engaged with the latch retaining portion to lock the latch in the engaged position, thereby maintaining the cap section in the closed position. The biasing member is tensioned by the base section when the cap section is in the closed position such that the biasing member biases the latch engaging portion so as to cause it to remain locked in the engaged position, thereby maintaining the latch in the engaged position.

36 Claims, 6 Drawing Sheets

LOCKING LATCH MECHANISM FOR AN INSULATION DISPLACEMENT CONNECTOR

FIELD OF THE INVENTION

This invention relates generally to the field of telephone wire connectors and distribution systems, and specifically to a locking latch mechanism for an insulation displacement connector (IDC).

BACKGROUND OF INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit (NIU). Within such devices the individual telephone line tip ring pairs are separated from the cable, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that the subscriber can isolate troubles on the line as originating in the telephone network, or on the terminal equipment side of the telephone line.

Additionally, there are known insulation displacement connector (IDC) blocks for use in such junction boxes and/or distribution fields, such as the ubiquitous punch down connector block, also known as a 66-type connector block, and the tool-less insulation displacement connector blocks utilizing push cap connectors, such as that described in U.S. Pat. No. 4,913,659 dated Apr. 3, 1990, the entire disclosure of which is incorporated herein by reference. Such a connector block is commercially available under the product designation SC99 from Lucent Technologies Inc. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971. Also widely available are tool-less IDC's known as Mini-Rocker Connectors such as those sold by A. C. Egerton Ltd., which hold a tip-ring wire pair in terminals retained under a single movable cap through which both wires of the pair are inserted.

The cap section and base section of mini-rocker tool-less IDC connectors are held together by a latching mechanism known in the art. This prior art latching mechanism does not include any means to retain the latch in an engaged position. In order to achieve good latching performance, a significant amount of movement and deflection of the latch is required. This movement is facilitated by a living hinge. Reference is first made to FIG. 1 which illustrates an insulation displacement connector constructed in accordance with the prior art, generally indicated as 10. Connector 10 has a cap section, generally indicated as 12, and a base section, generally indicated as 14. Cap section 12 is hingedly connected to base section 14 at a hinged pivot point 32. Cap section 12 pivots about pivot point 32 and is movable between an open position and a closed position. FIG. 1 illustrates cap section 12 in the closed position. Base section 14 is fixed and generally includes at least one terminal strip 28 of an art recognized type.

Cap section 12 includes a latch 15 which is movable between an engaged position and a disengaged position. FIG. 1 illustrates latch 15 in the engaged position. Latch 15 includes a latch engaging portion 16. Base section 14 includes a latch retaining portion 38. When cap section 12 is in the closed position, as illustrated in FIG. 1, latch 15 is in the engaged position. In this orientation, latch engaging portion 16 confrontingly abuts and engages latch retaining portion 38, thereby maintaining cap section 12 in the closed position. In order to open cap section 12, latch 15 must first be moved to the disengaged position. Latch 15 is maintained in its engaged position by the elasticity of a living hinge 24.

Latch 15 also includes a latch base 17 which is used in conjunction with a finger grip member 34. Latch base 17 and finger grip member 34 have defined therebetween an aperture 36. Movement of latch 15 between the engaged and disengaged positions can be accomplished by gripping connector 10 between latch 15 and finger grip member 34. Upon the application of pressure, latch 15 pivots about living hinge 24, with engaging portion 16 moving in direction Z while latch base 17 is pressed in direction Y. By applying sufficient pressure such that latch 15 is pivoted about living hinge 24 by a sufficient distance in the Z direction, latch engaging portion 16 can be disengaged from latch retaining portion 38, and cap section 12 can be moved into the open position.

While this prior art IDC works for its intended purpose, a significant drawback to this prior art IDC is that with the passage of time and the effects of changes in temperature and pressure, living hinge 24 tends to lose its elastic properties. Consequently, latch 15 can become disengaged from its engaged position because latching engaging portion 16 can slide out and away from latch retaining portion 38. Thus, if the connector wires are pulled upward during a wire tracing operation, as known in the art, the cap tends to open. This can cause early and unwanted disengagement of the wires from the connector, permitting installed wires to disconnect.

SUMMARY OF THE INVENTION

The present invention is directed at overcoming shortcomings in the prior art. Generally speaking, in accordance with the present invention, a locking latch mechanism for an insulation displacement connector comprises a cap section including a biasing member, a base section and a latch member. The biasing member is preferably configured as a type of spring. The cap section is movable between an open position and a closed position. The base section is hingedly connected to the cap section and includes a latch retaining portion. The latch member is movable between an engaged position and a disengaged position such that the latch member maintains the cap section in the closed position when the latch member is in the engaged position. The latch member includes a latch engaging portion which is lockingly matingly engaged with the latch retaining portion to lock the latch in the engaged position, thereby maintaining the cap in the closed position. The biasing member is tensioned by the base section when the cap section is in the closed position such that the biasing member biases the latch engaging portion so as to cause it to remain locked in the engaged position, thereby maintaining the latch in the engaged position independent of the hinge by which the latch pivots. Specifically, the cap cannot be opened by simply pivoting the latch as in the prior art. To pivot the latch, the cap must first be pushed downward to overcome the biasing member and to release the latch lock. Only then may the latch be disengaged in an ordinary manner, and the cap opened.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
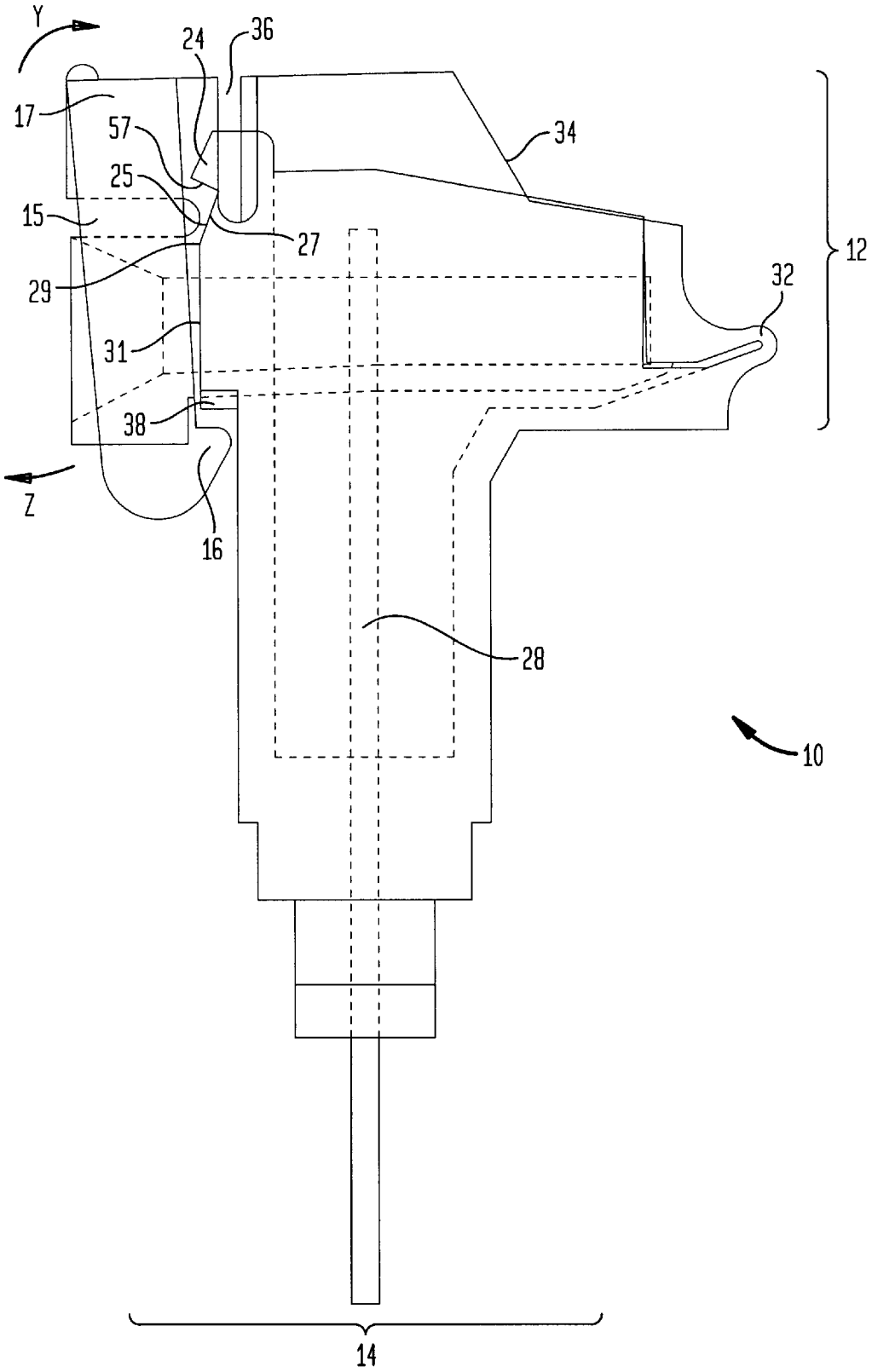
FIG. 1 (PRIOR ART)
FIG. 1 is a side elevational view of a connector constructed in accordance with the prior art with the cap section in the closed position.
Figure 2:
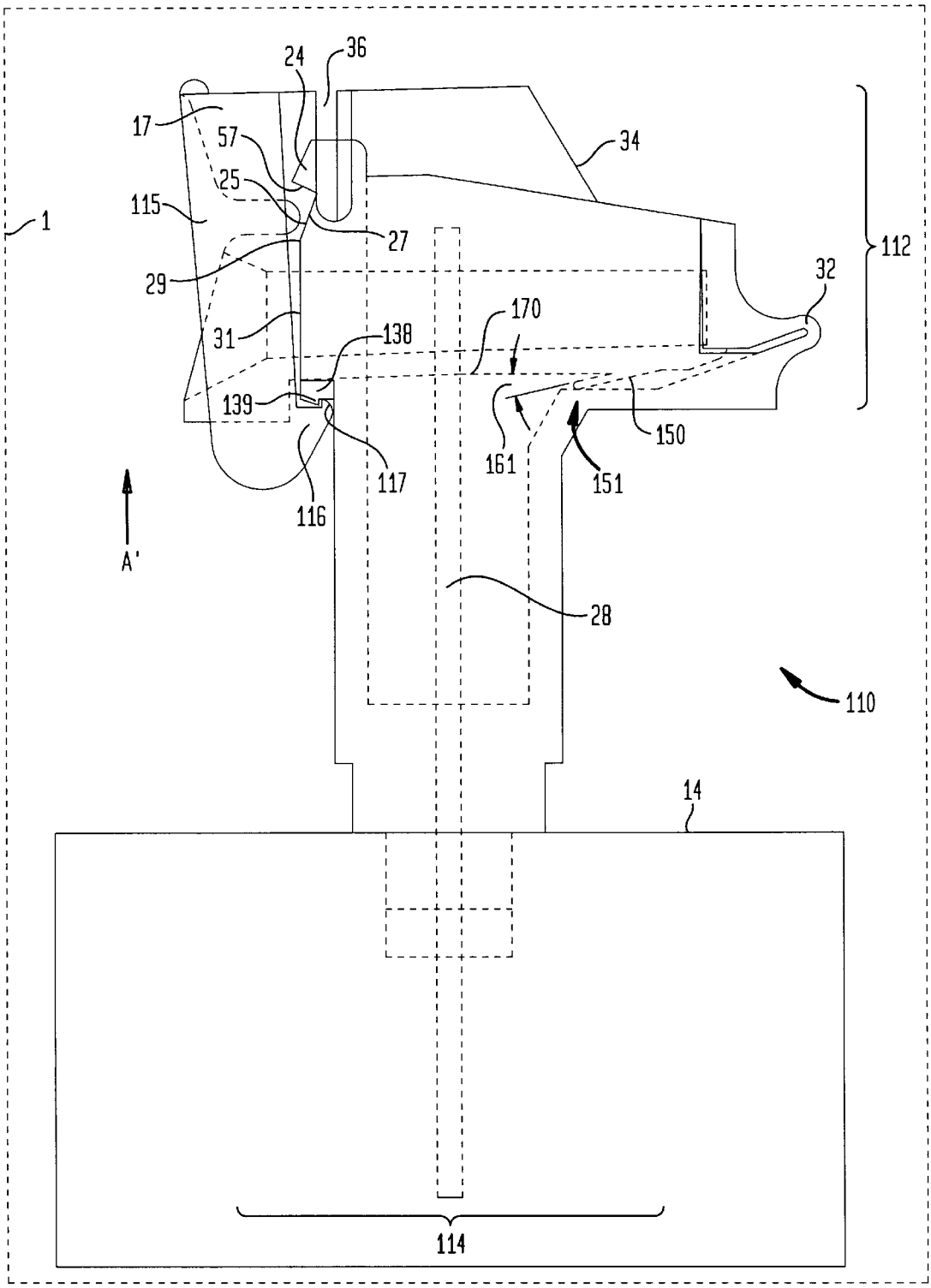
FIG. 2 is a side elevational view of a connector constructed in accordance with a preferred embodiment of the present invention with the cap in the closed position.
Figure 3:
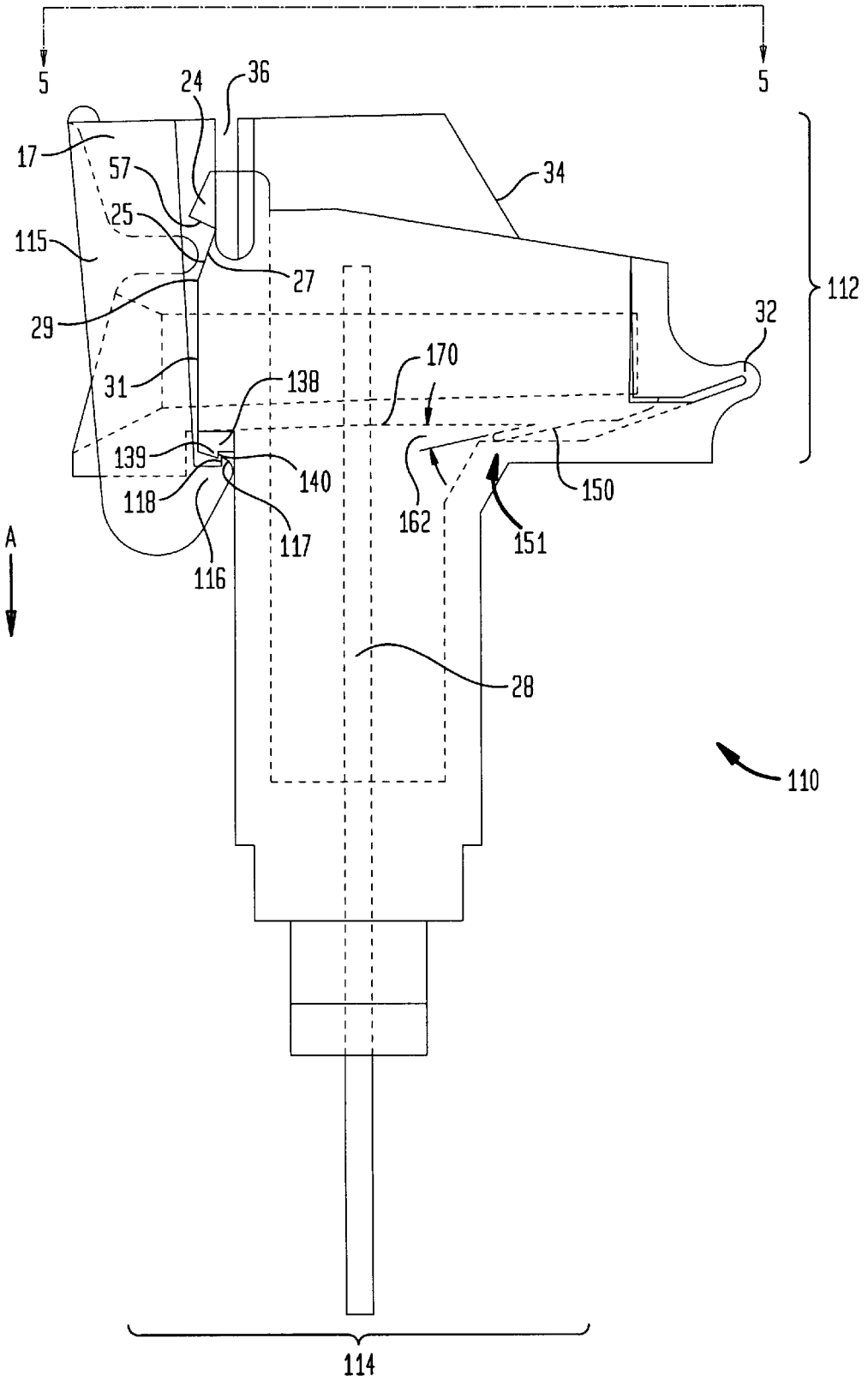
FIG. 3 is a side elevational view of the connector of FIG. 2 with the latch in the unlocked position.
Figure 4:
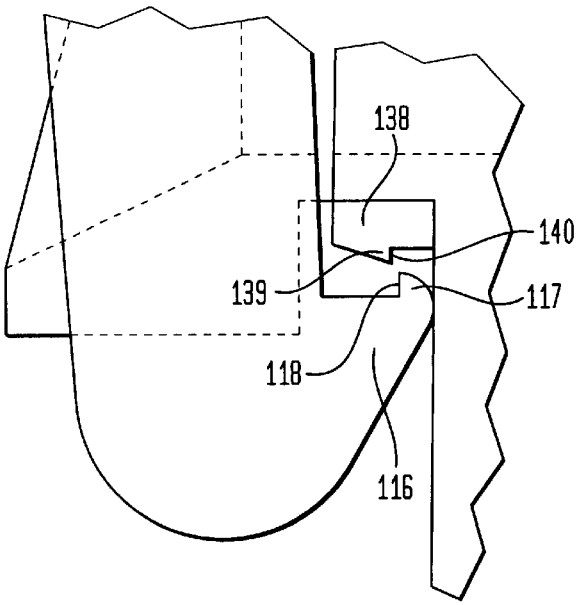
FIG. 4 is a magnified detail view of the latch of FIG. 3.
Figure 5:
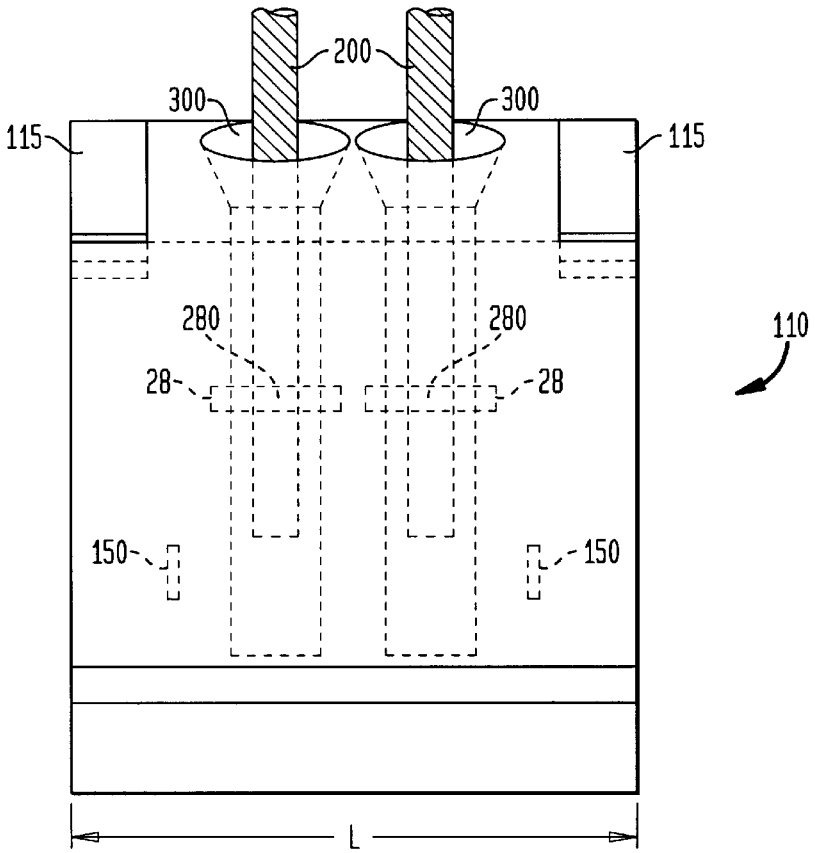
FIG. 5 is a top plan view of the connector of FIG. 3 viewed along the line 5—5 of FIG. 3.
Figure 6:
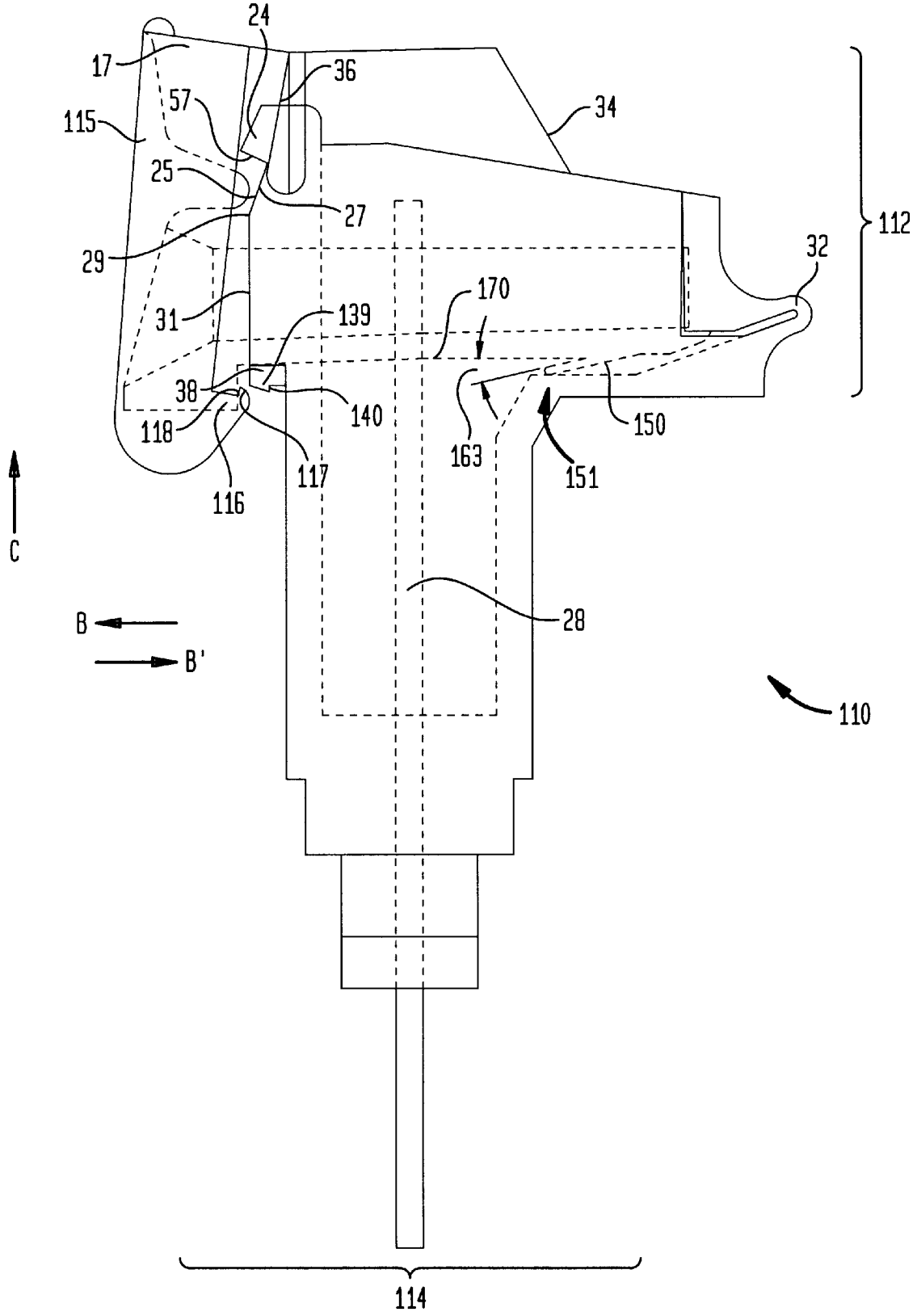
FIG. 6. is a side elevational view of the connector of FIG. 2 with the latch in the disengaged position.
Figure 7:
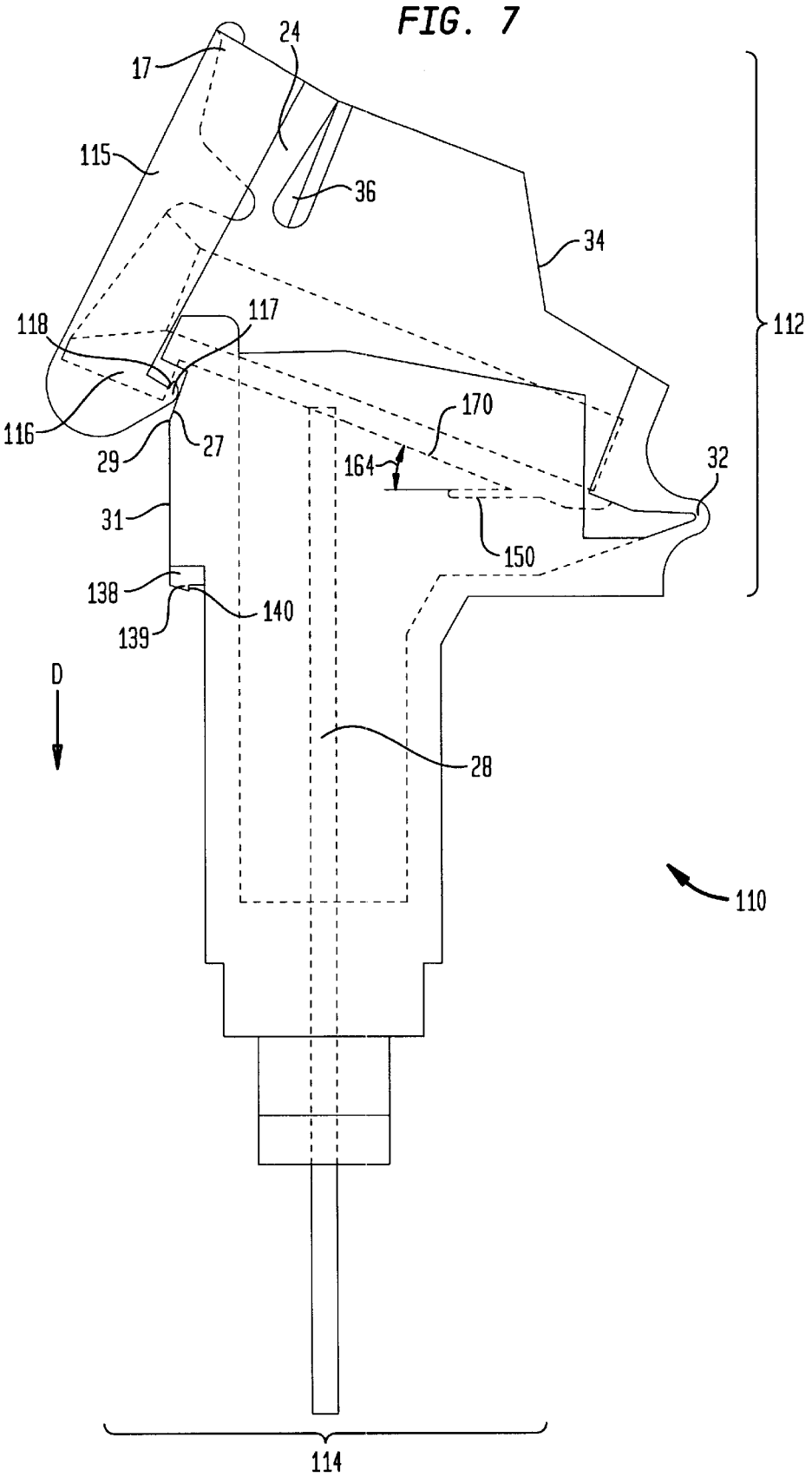
FIG. 7 is a side elevational view of the connector of FIG. 2 with the cap section in the open position.

Reference is made to FIGS. 2, 3 and 5–7, which illustrate an insulation displacement connector of the present invention, generally indicated as 110, and FIG. 4 which illustrates a magnified detail view of FIG. 3. Connector 110 has a cap section, generally indicated as 112, and a base section, generally indicated as 114. Cap section 112 is hingedly connected to base section 114 at a hinged pivot point 32. Cap section 112 pivots about pivot point 32 and is movable between open position, as illustrated in FIG. 7, and a closed position, as illustrated in FIG. 2. Base section 114 is fixed and generally includes at least one terminal strip 28 of an art recognized type. Connector 110 may be mounted in a connector block 14, which in turn may be mounted in a wiring enclosure 1.

Cap section 112 includes a latch 115 which is movable between an engaged position, as illustrated in FIG. 2, and a disengaged position, as illustrated in FIGS. 3-7. Latch 115 includes a latch engaging portion 1 16. Latch engaging portion 1 16 includes a catch 1 17 having a catch wall 118. Base section 114 includes a latch retaining portion 138. Latch retaining portion 138 includes a locking tab 139 having a locking wall 140. When cap section 112 is in the closed position, latch 115 is in the engaged position. In this position, latch engaging portion 116 lockingly matingly engages latch retaining portion 138, thereby maintaining cap section 112 in the closed position. Specifically, catch wall 118 of catch 117 confrontingly abuts and engages locking wall 140 of locking tab 139. In order to open cap section 112, latch 115 must first be forced downward, in a direction represented by arrow A in FIG. 3, so as to unlock latch engaging portion 116 from latch retaining portion 138, and subsequently forced forward, in a direction represented by arrow B in FIG. 6, so as to swing latch 115 into the disengaged position. Thus, the disengaging of latch 115 is a two-step process including the unlocking of latch 115 in direction A, (FIG. 3) followed by the swinging-away of latch 115 in direction B (FIG. 6).

Latch 115 also includes a latch base 17 which is connected to cap section 112 and is used in conjunction with a finger grip member 34. Latch base 17 and finger grip member 34 define an elongated opening or aperture 36 therebetween. Aperture 36 can be a variety of shapes and sizes as a matter of application specific design choice.

Cap section 112 also includes a biasing member 150. In a preferred embodiment, biasing member 150 is an elastically deformable biasing member integrally formed in cap section 112. In a preferred embodiment, biasing member 150 may be positioned along the length L of cap section 112, as illustrated in FIG. 5. Further, cap section 112 may include a plurality of biasing members 150. FIG. 5 depicts connector 110 having two biasing members 150.

In the closed position, as illustrated in FIG. 2, when latch 115 is in the engaged position, biasing member 150 is tensioned by the inner wall of base section 1 14 at a pressure zone 151. In this orientation, biasing member 150 defines a first angle 161 with a first wall 170 of cap section 112. Consequently, biasing member 150 exerts an upward pressure in a direction represented by the arrow A' in FIG. 2, which biases latch engaging portion 116 in the engaged position, thereby maintaining cap section 112 in the closed position. Movement of latch 115 between the engaged and disengaged positions can be accomplished by gripping connector 110 between latch 115 and finger grip member 34. Pressure is then applied in the direction represented by arrow A in FIG. 3 to unlock latch engaging portion 116 from latch retaining portion 138. Pressure A must be greater than the biasing force A' in order to unlock latch 115, as illustrated in FIG. 3. In the unlocked position, as illustrated in FIG. 3, biasing member 115 defines a second angle 162 with first wall 170 of cap section 112. Second angle 162 is less than first angle 161. While gripping connector 110 between latch 115 and finger grip member 34, pressure is then applied in a direction represented by arrow B, as illustrated in FIG. 6, so as to swing latch 115 into the disengaged position. Latch 115 concurrently pivots about living hinge 24. In the unlatched position, as illustrated in FIG. 6, biasing member 150 defines a third angle 163 with first wall 170 of cap section 112. Third angle 163 is approximately equal to or smaller than second angle 162. The biasing force of biasing member 150 now biases cap section 112 in a direction represented by arrow C. Cap section 112 may be pivoted away from base section 114 until biasing member 150 is no longer in contact with base section 114 at pressure zone 150.

Upon movement of cap section 112 from the closed to open position, latch engaging portion 116 of latch 115 comes into contact with low interference region 31 which provides low interference to the motion of latch engaging portion 116 towards a high interference point 29. High interference point 29 provides the highest resistance to the movement of latch engaging portion 116. High interference point 29 is followed by a low interference region 25. As seen in side view, high interference point 29 protrudes beyond low interference region 31 and low interference region 25. After moving past high interference point 29, latch engaging portion 116 comes into contact with an abutment wall 57 in notch 27. When latch engaging portion 116 is housed in notch 27, as illustrated in FIG. 7, cap section 112 is in the fully open position. In this position, notch 27 of base section 114 maintains latch engaging portion 116 of latch 115 in the disengaged position. This force is transferred through latch 115 to living hinge 24, and consequently cap section 112 is retained in the open position. With cap section 112 in the fully open position, as illustrated in FIG. 7, biasing member 150 defines a fourth angle 164 with first wall 170 of cap section 112. Fourth angle 164 is larger than first angle 161, second angle 162 and third angle 163.

Reference is again made to FIG. 7, which depicts connector 110 with cap section 112 in the fully open position. To achieve the closed position, as illustrated in FIG. 2, pressure is applied on latch 115 in a direction represented by arrow D, to move latch 115 in a downward direction towards base section 114, through low interference regions 25 of notch 27, past high interference point 29 and low interference region 31 towards latch retaining portion 138. The pressure applied on latch 115 must be greater than the biasing pressure exerted by biasing member 150 and depicted as A' in FIG. 2. Once latch 115 is in a position wherein biasing member 150 is at third angle 163, a force is applied in the direction represented by arrow B', as illustrated in FIG. 6, to bring latch engaging portion 116 of latch 115 into a confronting orientation with latch retaining portion 138 of base section 114, as illustrated in FIG. 3. In this position, wherein biasing member 115 is at second angle 162, biasing member 150 causes latch engaging portion 116 to lockingly matingly engage with latch retaining portion 138, as seen in FIG. 2. In the position depicted in FIG. 2, biasing member 150 biases latch engaging portion 116 in the engaged position thereby maintaining the latch in the engaged position and cap section 112 in the closed position.

Base section 114 of connector 110 preferably includes at least one terminal strip 28. Generally, as known in the art, an insulation displacement connector can contain two terminal strips.

Cap section 112, base section 114, latch 115, and biasing member 150 may be formed of any art recognized material having the proper insulating and mechanical properties. Preferably, plastic is employed. Further, biasing member 150 may be made of any art recognized size, shape and material that has the appropriate mechanical and elastic properties to achieve the solutions taught herein, such as, for example, coil springs, torsion rods, bladders, and the like. Further, the connector of the present invention may be used, alone or as one of an array of connectors on a connector block, in a wiring enclosure, such as, for example, a Building Entrance Protector (BEP) or Network Interface Unit (NIU).

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. An insulation displacement connector comprising:

a cap section movable between an open position and a closed position, said cap section including a biasing member;

a base section hingedly connected to said cap section, said base section including a latch retaining portion;

an insulation displacement connector terminal strip having a wire receiving portion for mechanically and electrically mating with a conductor, said cap having an aperture for receiving said conductor, said cap driving said conductor into mating engagement with said wire receiving portion when said cap is moved into said closed position:

a latch member mounted on said cap section and movable between an engaged position and a disengaged position, said latch member maintaining said cap section in said closed position when said latch member is in said engaged position, said latch member including a latch engaging portion for lockingly matingly engaging said latch retaining portion when said cap section is in said closed position; and said biasing member being tensioned by said base section when said cap section is in said closed position such that said biasing member biases said latch engaging portion in said engaged position thereby maintaining said latch in said engaged position.

2. The locking latch mechanism of claim 1, wherein said cap section includes a plurality of biasing members.

3. The locking latch mechanism of claim 1, wherein said latch engaging portion includes a catch having a catch wall and said latch retaining portion includes a locking tab having a locking wall, said catch wall of said catch confrontingly engaging said locking wall of said locking tab when said latch is in said engaged position.

4. The locking latch mechanism of claim 1, wherein said cap section includes a first wall, said biasing member being connected to said first wall.

5. The locking latch mechanism of claim 4, wherein said biasing member and said first wall of said cap section define a first angle therebetween when said latch is in said engaged position.

6. The locking latch mechanism of claim 5, wherein said biasing member and said first wall of said cap section define a fourth angle therebetween when said cap section is in said open position.

7. The locking latch mechanism of claim 6, wherein said first angle is less than said fourth angle.

8. The locking latch mechanism of claim 1, wherein said cap section includes a finger grip member.

9. The locking latch mechanism of claim 1, wherein said base section is connected to said cap section at a pivot point.

10. The locking latch mechanism of claim 1, wherein said base section includes a notch, said notch having a high interference point, a low interference region and an abutment wall.

11. The locking latch mechanism of claim 1, wherein said cap section comprises one or more terminal strip receiving portions.

12. The locking latch mechanism of claim 1, wherein said base section comprises one or more terminal strips.

13. The locking latch mechanism of claim 1, wherein said insulation displacement connector is disposed on a connector block.

14. The locking latch mechanism of claim 1, wherein said insulation displacement connector is disposed in a wiring enclosure.

15. An insulation displacement connector with a locking latch comprising:

a base section;

a cap section hingedly connected to said base and moveable between an open and a closed position, said cap having a biasing member that biases said cap away from said base when in said closed position;

an insulation displacement connector terminal strip having a wire receiving portion for mechanically and electrically mating with a conductor, said cap having aperture for receiving said conductor, said cap driving said conductor into mating engagement with said wire receiving portion when said cap is moved into said closed position;

a latch hingedly connected to said cap and engageable with said base for maintaining said cap in said closed position when said latch is in an engaged position; and a locking mechanism formed partially on said latch and partially on said base for locking said latch in said engaged position, said locking mechanism being retained in a locked position by said biasing member such that unlocking said lock requires movement of said cap toward said base to overcome the bias exerted by said biasing member.

16. The insulation displacement connector of claim 15, wherein said locking mechanism comprises a latch retaining portion disposed on said base section and a latch engaging portion disposed on said latch, said latch engaging portion lockingly matingly engaging said latch retaining portion when said cap section is in said closed portion.

17. The insulation displacement connector of claim 16, wherein said cap section includes a plurality of biasing members.

18. The insulation displacement connector of claim 16, wherein said latch engaging portion includes a catch having a catch wall and said latch retaining portion includes a locking tab having a locking wall, said catch wall of said catch confrontingly engaging said locking wall of said locking tab when said latch is in said engaged position.

19. The insulation displacement connector of claim 16, wherein said cap section includes a first wall, said biasing member being connected to said first wall.

20. The insulation displacement connector of claim 19, wherein said biasing member and said first wall of said cap section define a first angle therebetween when said latch is in said engaged position.

21. The insulation displacement connector of claim 20, wherein said biasing member and said first wall of said cap section define a fourth angle therebetween when said cap section is in said open position.

22. The insulation displacement connector of claim 21, wherein said first angle is less than said fourth angle.

23. The insulation displacement connector of claim 16, wherein said cap section includes a finger grip member.

24. The insulation displacement connector of claim 16, wherein said base section is connected to said cap section at a pivot point.

25. The insulation displacement connector of claim 16, wherein said base section includes a notch, said notch having a high interference point, a low interference region and an abutment wall.

26. The insulation displacement connector of claim 16, wherein said cap section comprises one or more terminal strip receiving portions.

27. The insulation displacement connector of claim 16, wherein said base section comprises one or more terminal strips.

28. The insulation displacement connector of claim 16, wherein said insulation displacement connector is disposed on a connector block.

29. The insulation displacement connector of claim 16, wherein said insulation displacement connector is disposed in a wiring enclosure.

30. An insulation displacement connector comprising:

a cap moveable between an open position and a closed position;

a base hingedly connected to said cap;

a latch mounted on said cap and moveable between an engaged position and a disengaged position;

an insulation displacement connector terminal strip having a wire receiving portion for mechanically and electrically mating with a conductor, said cap having an aperture for receiving said conductor, said cap driving said conductor into mating engagement with said wire receiving portion when said cap is moved into said closed position;

a locking mechanism formed partially on said latch and partially on said base for locking said latch in said engaged position; and a biasing member connected to said cap and biasing said latch member into said engaged position.

31. The insulation displacement connector of claim 1, wherein said biasing member is located closer to said hinged connection of said base section to said cap section than is said latch.

32. The insulation displacement connector of claim 1, wherein said latching member is directed in a direction generally toward said hinged connection of said base section to said cap section.

33. The insulation displacement connector of claim 15, wherein said biasing member is located closer to said hinged connection of said base section to said cap section than is said latch.

34. The insulation displacement connector of claim 15, wherein said latching member is directed in a direction generally toward said hinged connection of said base section to said cap section.

35. The insulation displacement connector of claim 30, wherein said biasing member is located closer to said hinged connection of said base section to said cap section than is said latch.

36. The insulation displacement connector of claim 30, wherein said latching member is directed in a direction generally toward said hinged connection of said base section to said cap section.

* * * * *